United States Patent [19]

Burnham

[11] Patent Number: 4,951,330

[45] Date of Patent: Aug. 28, 1990

[54] KNOCK-DOWN CRIB CONSTRUCTION WHEREIN NO TOOLS OR EXTRANEOUS FASTENINGS ARE NEEDED

[75] Inventor: Benjamin K. Burnham, Merrimack, N.H.

[73] Assignee: Gem Industries, Inc., Gardner, Mass.

[21] Appl. No.: 374,184

[22] Filed: Jun. 30, 1989

[51] Int. Cl.[5] ..... A47D 7/00

[52] U.S. Cl. ..... 5/93 R; 5/11; 5/207

[58] Field of Search ..... 5/11, 93 R, 99 B, 100, 5/201, 207, 208, 209

[56] References Cited

U.S. PATENT DOCUMENTS

| | | | |
|---|---|---|---|
| 1,862,383 | 6/1932 | Mayette | 5/100 |
| 2,311,892 | 2/1943 | Uline | 5/11 |
| 2,328,316 | 8/1943 | Webb | 5/11 |
| 2,434,620 | 1/1948 | Landry et al. | 5/11 |
| 3,646,622 | 3/1972 | Van Riper, Jr. | 5/100 |
| 3,896,514 | 7/1975 | Feldstein | 5/100 |
| 4,724,556 | 2/1988 | Burnham | 5/100 |
| 4,825,482 | 5/1989 | Paris | 5/100 X |

*Primary Examiner*—Michael F. Trettel
*Attorney, Agent, or Firm*—Charles R. Fay

[57] ABSTRACT

A knock-down crib including two end pieces or panels with corner posts at their side edges; a front dropside and a rear side, guides on the corner posts, brackets on the upper and lower rails of the dropsides, slidable automatic latches on the brackets on the lower rails, and sliding engagement means at the ends of the upper rail of the dropsides to position the sides with respect to the end pieces or panels, and to hold the parts together in assembled relation, the assembly of all the parts being without the need for any tool and without any extraneous fasteners such as screws.

2 Claims, 5 Drawing Sheets

KNOCK-DOWN CRIB CONSTRUCTION WHEREIN NO TOOLS OR EXTRANEOUS FASTENINGS ARE NEEDED

FIELD OF THE INVENTION

A knock-down crib construction wherein no tools or extraneous fastenings are needed.

BACKGROUND OF THE INVENTION

Furniture of the class including childrens' cribs, play yards, etc , are normally sold by having a display in the store, and presenting the purchaser with a generally flat cardboard box of a dimension to accommodate the largest pieces in flat-wise relation stacked on or beneath the other parts. In the case of a crib, the largest parts are the front and rear sides and the mattress support; the two end pieces bearing the corner posts are smaller, and in this case there are two angle irons that help to rigidify the crib. Through a novel interengagement of parts on the corner posts and on the ends of the top and bottom rails of the crib sides, a sturdy crib is provided to be set up by the buyer without the use of extraneous fasteners, often lost, or any tools. The construction is especially attractive because the user can buy a knock-down construction having both front and rear drop sides all self contained with nothing to be done to them except to connect them to the corner posts by means factory installed devices on the corner posts and the top and bottom rails the dropsides.

SUMMARY OF THE DISCLOSURE

The crib of the present invention comprises two facing end pieces or panels, each of which has vertical corner posts at the opposite thereof, or similar structure, and on each corner post, facing each other in a front side pair and a rear side pair, there are guides and latch plates and a support holder for an extending end of a spring support There are two spaced guides on each corner post, these guides being spaced and longitudinally aligned, but it is to be noted that a single piece each bearing the two guides, and between guides, the spring support holders.

Thus, there is on each corner post an upper guide, a lower guide, and spring support holder. The upper guide is merely a section of material with parallel edge undercuts forming lips to vertically guide and hold against endwise motion, the top rail of the dropside, this upper or top rail having at its ends mirror-image brackets engaged in the grooves occasioned by the undercuts in the upper guides on the corner pieces.

Below the upper guides on each corner post is a spring support holder that is adjustable up and down on the same or similar guide as above described, and below these holders are locking brackets on the ends of the bottom rail also slidable on the respective guide and having a pivot lock for engagement in apertures in the guides for holding the dropside in raised position. This locking mechanism also holds the dropside from falling below a certain predetermined level, but upon being deliberately manually retracted, the dropside can be disengaged from the crib entirely. The lock is made in a way to require a short lifting action by the attendant plus an inward push to free the drop side from the corner posts, to drop it to down or open position of the dropside.

The prior art in general is probably best exemplified in U.S. Pat. No. 4,724,556, Feb. 18, 1988.

PREFERRED EMBODIMENT OF THE INVENTION

Figure 1:
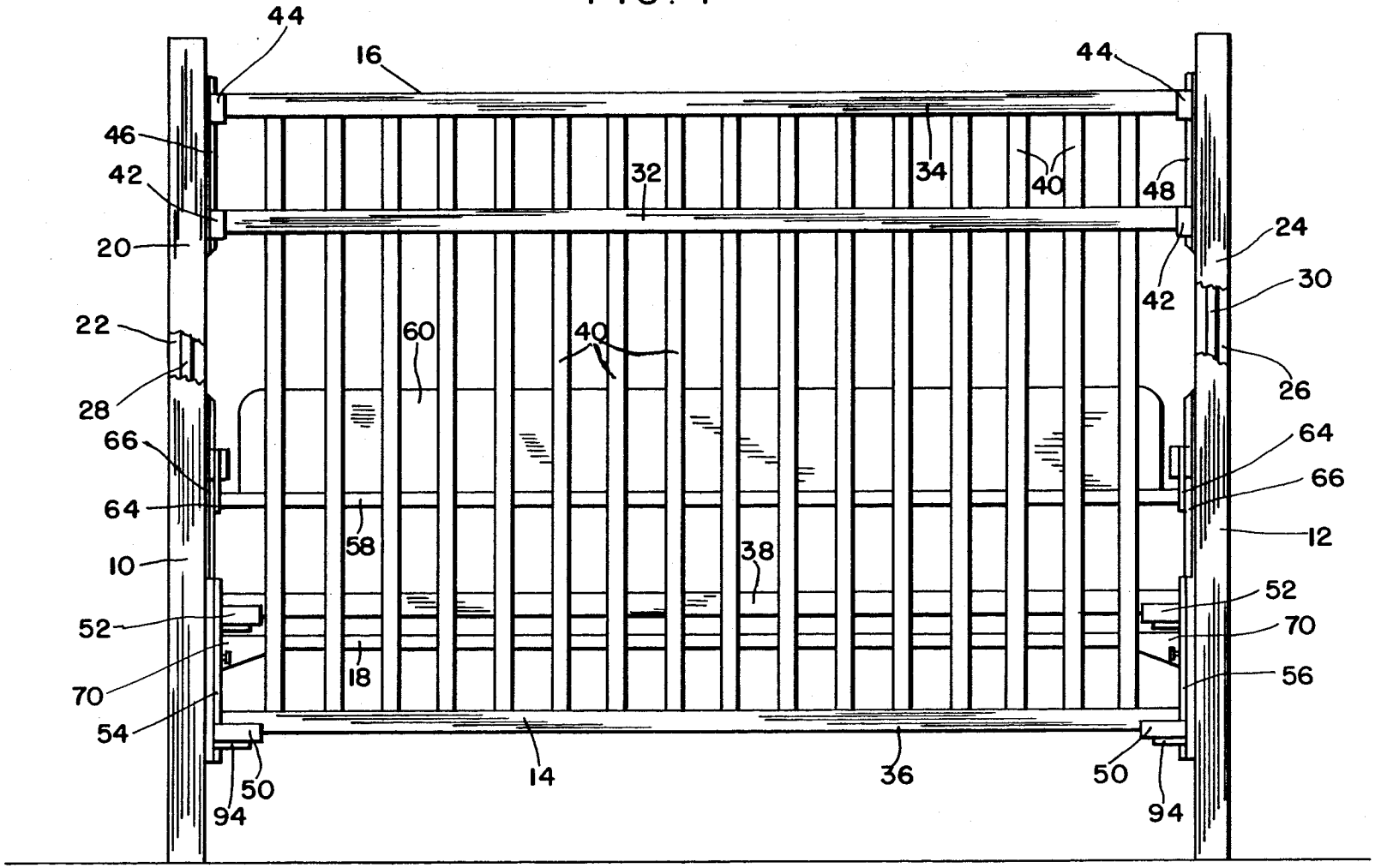
FIG. 1 is a front elevational view of a crib according to the present invention.

FIG. 1 shows the crib from the front. The crib shown has end wall or panel 10 and end wall or panel 12. These panels are alike in a mirror image construction. There is a front dropside 14 and a rear dropside 16, but the rear dropside could be arranged to be fixed if desired but this is no part of the present invention. The two dropsides are alike but as will be shown they must each have an inside aspect and an outside aspect as respects the crib. There is also a stabilizer rod or bar 18 which is mounted on and between the two end walls or panel 10 and 12.

Each end wall or panel has two edge located corner posts, as at 20, 22, 24 and 26, and the end walls or panels are made up of vertical stiles 28, 30, etc., there being several such stiles spaced close enough for child safety.

Each dropside has an upper or top rail 32, 34 and a lower or bottom rail 36, 38, and of course these rails are connected by spaced stiles 40. The top rails 32, 34 have end brackets 42, 44 that slide on guides 46, 48 on the facing sides of corresponding corner posts 20, 22, 24, 26, to be more fully described. The bottom rails 36, 38 have end brackets 50, 52 that not only slide on guides 54, 56, but these brackets 50, 52 have spring-pressed pivoted latches to hold the dropsides in up or down relation. In FIG. 1, the front dropside is shown down and the rear dropside s shown in its up position. Both of these dropside positions are easily changed to the opposite, down position and up position, by the attendant.

There is a spring 58 for a mattress 60. This spring is a rectangular frame that has end projections 62, FIG. 7, that are supported in adjustable brackets 64 on guides 66. As will be described hereafter, the three in line guides, e.g. at 46 or 48, 54 or 56, and 66, could all be on a single Plastic or metal strip extending a distance not quite the length of its supporting corner post, or they may be in three separate parts per corner post, or in a different relation, but their relationship is the same and they form slide guides and supports for the top and bottom rails and the bed spring, and they hold the crib together in stable condition with no further parts or any fastenings that have to be applied or abstracted for set-up or knock-down. There are no further crib parts, but the details of the guides and the brackets for the top and bottom rails and the crib spring are to be described.

It is to be noted that the present crib has no dropside droprods and no centrally located dropside latch actuator, but is structured in general to the showing in U.S. Pat. No. 4,724,556, the main difference is that the present crib has no extraneous fasteners e.g. screws, for the ultimate consumer to have to struggle with, and is set up and knocked down without tools or such fasteners, the various parts not requiring any subassembly, but being assembled from the factory made parts very simply to make the crib. This is largely accomplished by having the guides as at 46, 54, and 66 open ended for the slide-on reception of the brackets 42, 50, and 64, brackets 42 and 50 being factory assembled on the top and bottom rails of the dropsides. Once in place, the dropside can slide up and down and also connect the end walls or panels 10 and 12 in a rigid rectangle. The stabilizer bar 18 is applied also by brackets 70 onto spring holders or receptors 72 therefore. This is a simple manual action. The receptors 72 are factory mounted on the end walls or panels 10 and 12.

As indicated, the guides 46, 54, and 66 may all be made in one piece with reduced ends as at 74 to help start the brackets 42, 50, and 66 along the guides or the guides may be separate and independent or two can be in one piece with the other separate as shown here, all with reduced entry ends. The guides are all undercut at the edges to provide grooves 76 by which the inturned feet as at 78 on all three brackets are conjoined with the guides by being received in grooves 76. The brackets are assembled to the guides by slipping them on the ends of the guides at their ends. Thus, it is clear, the uppermost brackets 42, 44 are slid onto guides 46, 48 from the lower ends of these guides which are long enough to hold the top rails of the dropsides in assembled relation throughout all of the dropsides motion, see FIG. 1.

Figure 2:
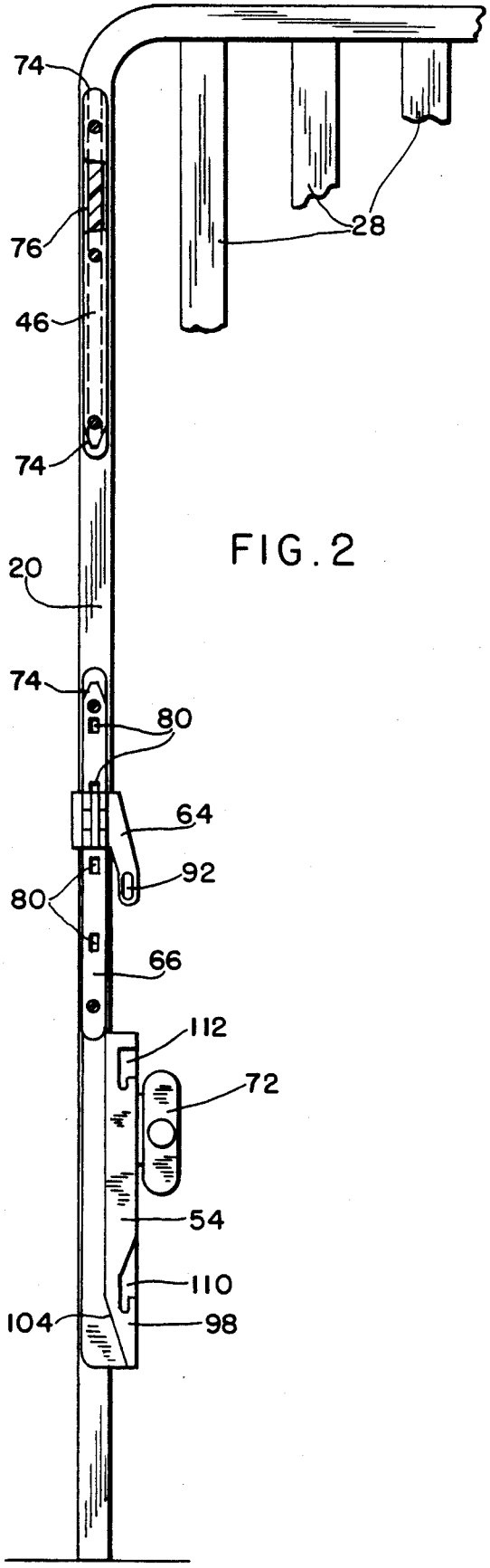
FIG. 2 is an elevational view on an enlarged scale of the inside aspect of a corner post, parts in section.
Figure 3:
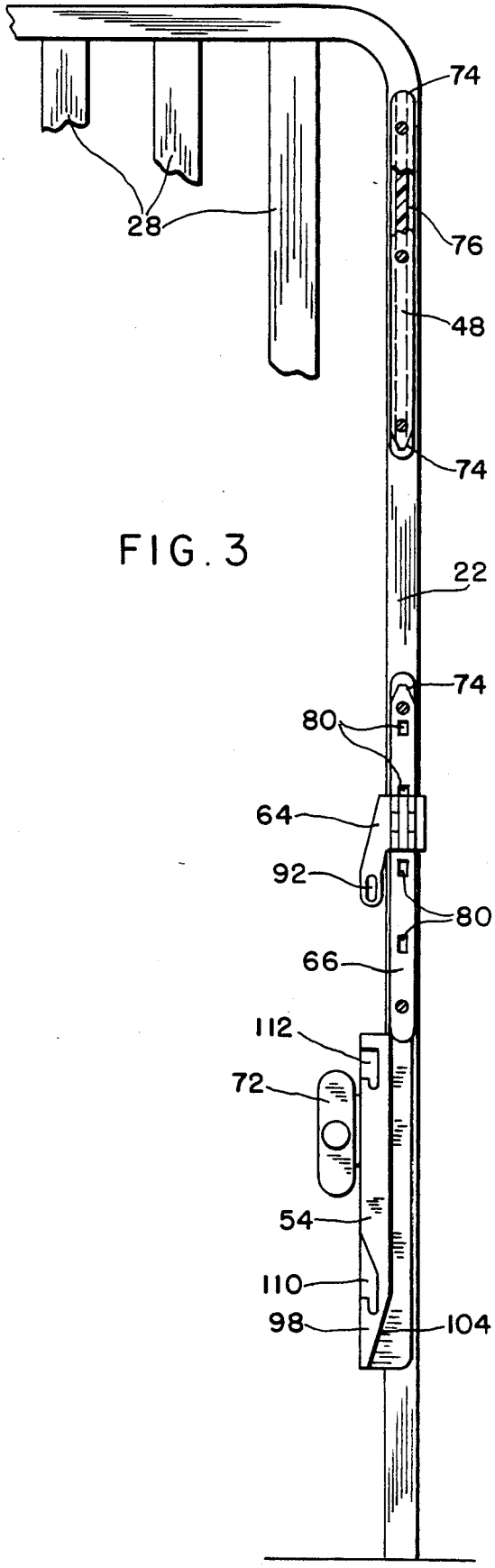
FIG. 3 is a similar view of a corner post at the opposite side of the crib.
Figure 6:
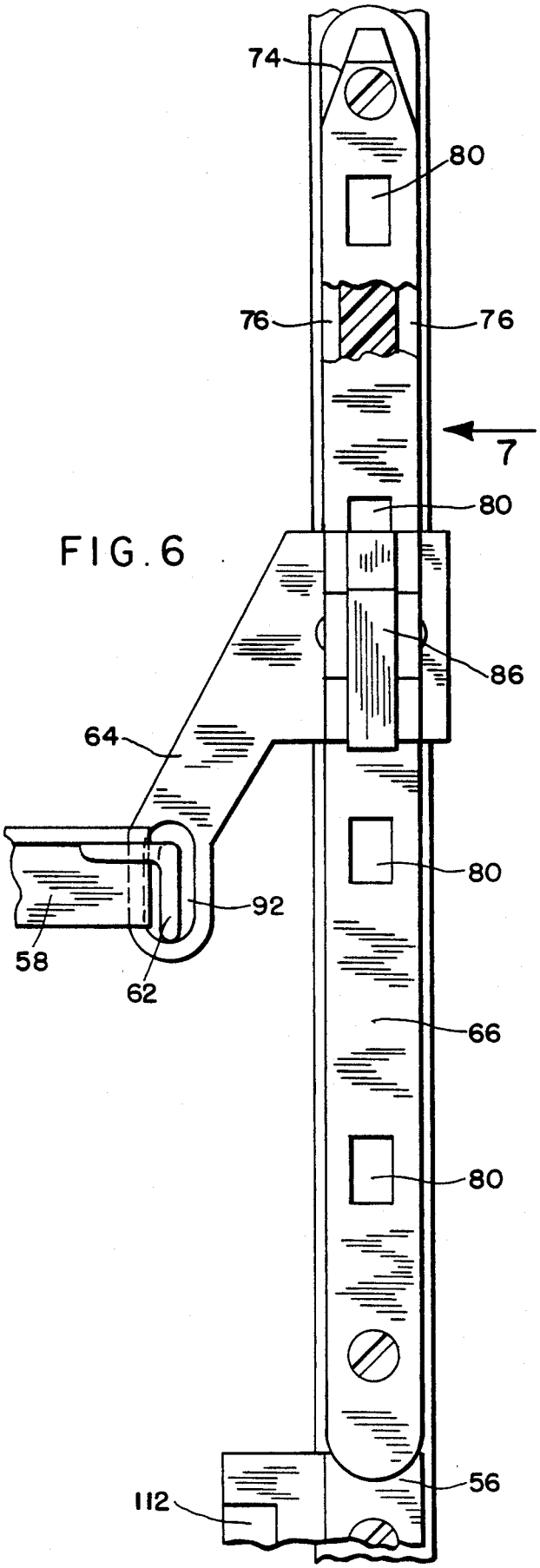
FIG. 6 is a front view of the spring support bracket in relation to the central portion of the guide.
Figure 7:
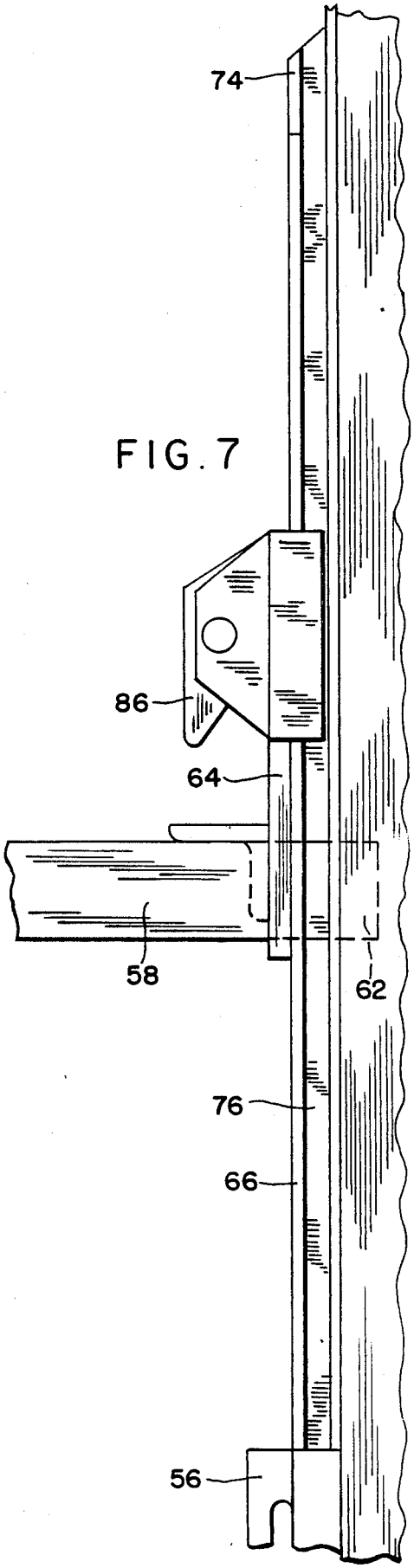
FIG. 7 is a view looking in the direction of arrow 7 in FIG. 6.
Figure 9:
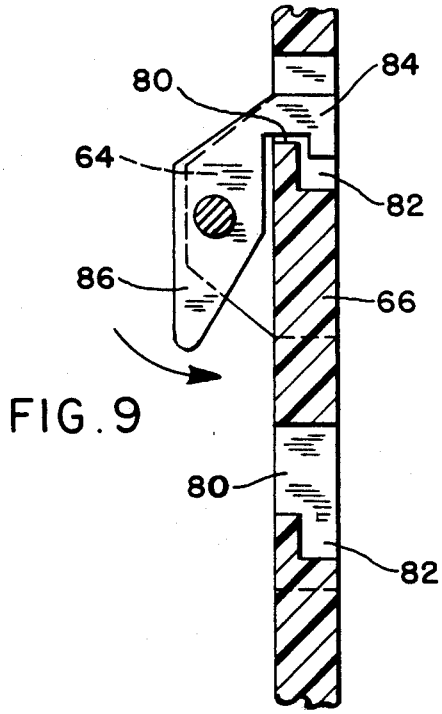
FIG. 9 is a sectional view of a central portion of the guide member showing the adjustment of the bracket for the spring support.
Figure 10:
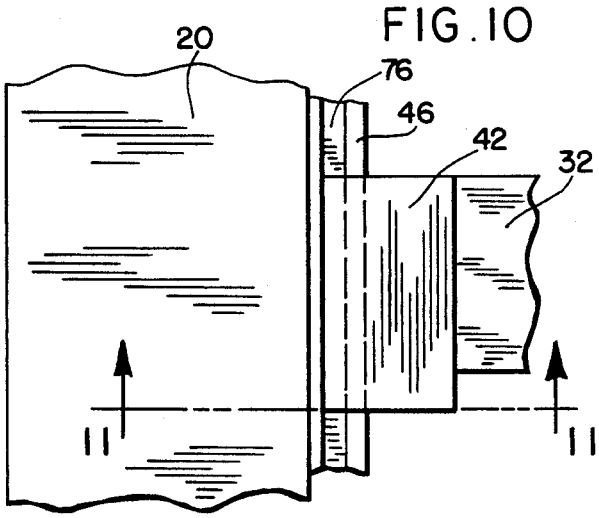
FIG. 10 is a detail view of the sliding connection between the upper or top rail of the dropside and the guide.
Figure 11:
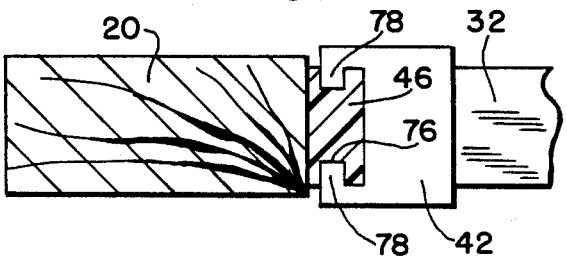
FIG. 11 is a section on line 11—11 of FIG. 10.
Figure 12:
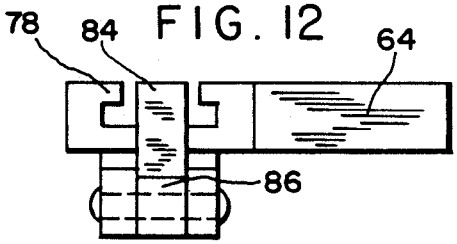
FIG. 12 is a detail of the spring support bracket.
Figure 13:
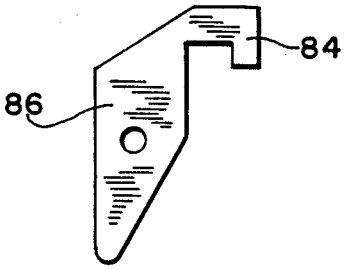
FIG. 13 is a detail of the catch for the bracket of FIG. 12.

The central guides 66 are shown to advantage in FIGS. 2, 6, and 7, with the brackets 64 in place. The inturned feet 78 are slid into the side edge grooves 76 in guide 66 which has apertures 80 therein with hollows 82 behind the apertures or forming part thereof, for the spring pressed reception of a hook 84 on a pivot member 86 on the bracket 64, see FIG. 9. The pivot member is manually pressed in the direction of the arrow in FIG. 9, against the spring action on hook 84, to release the hook 84 from guide 66 to release bracket 64 from its guide for vertical adjustment of brackets 64 and thus the mattress support 58. This mattress support (or bed spring) 58 has extending end members 62 that are lodged in apertures 92 in brackets 64, see FIG. 6. The pivot members 56 on the brackets 64 cannot be released unless the brackets 64 are raised significantly to allow the nooks 84 to be disengaged from the central guide 66.

Figure 4:
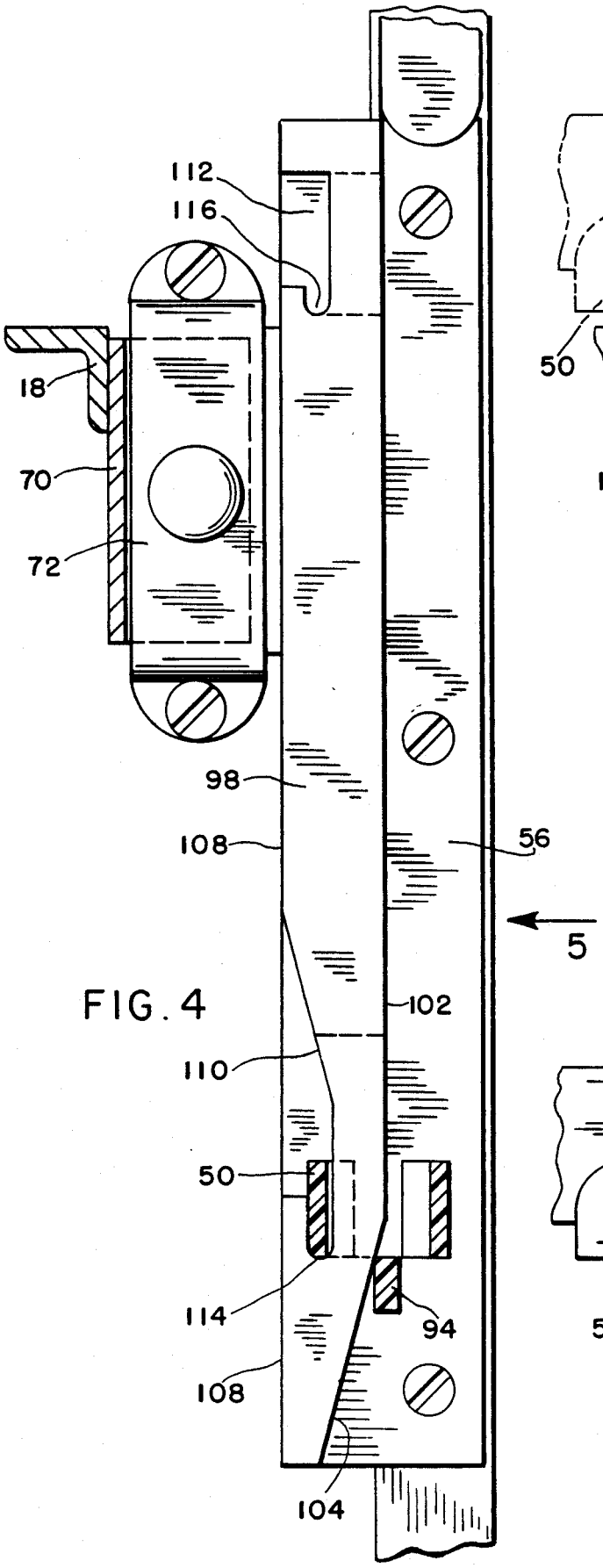
FIG. 4 is an elevational view on a still larger scale of the lowermost part of the corner post guide of FIG. 2.
Figure 5:
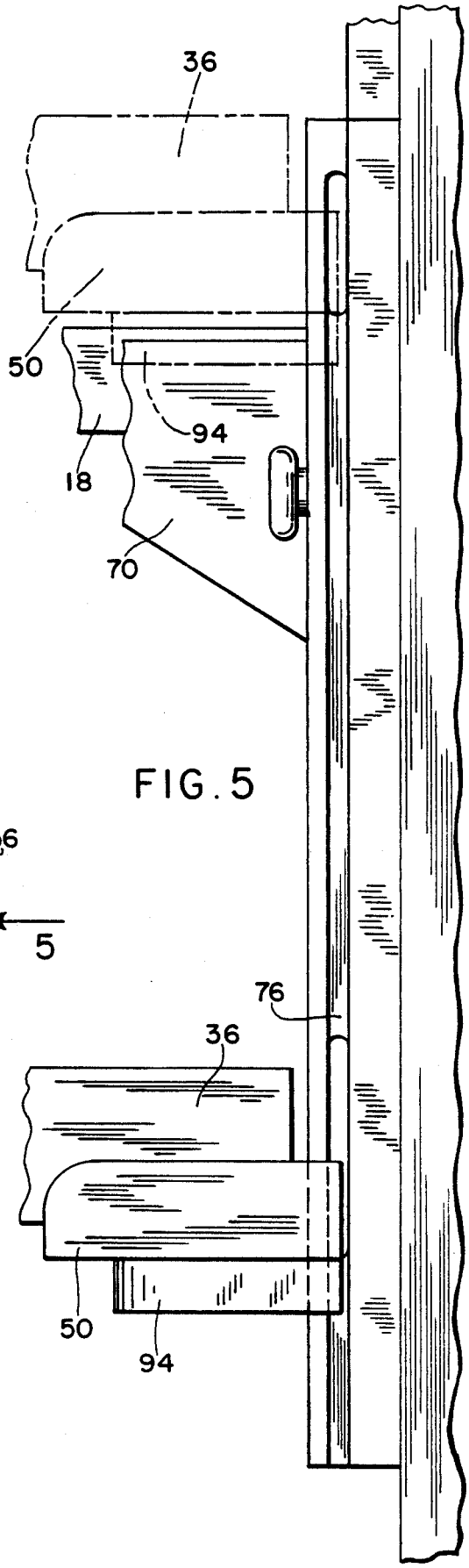
FIG. 5 is an elevational view looking in the direction of the arrow 5 in FIG. 4.
Figure 8:
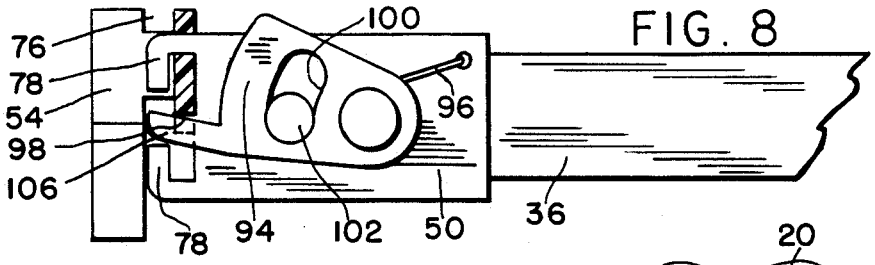
FIG. 8 is a bottom plan view of the dropside latch.

Most of the mechanism resides in the bracket 50, there being of course one such bracket at each end of each bottom rail 36 which cooperates with a guide 54 or 56 as the case may be. Bracket 50 has inturned feet 78 to run in grooves 76. Bracket 50 has a spring pressed pivoted latch member 94. This pivot member is spring pressed by a leaf or like spring 96 to press against the edge of an extension 98 on guide 54, or 56, see FIG. 4. Slot 100 and headed pin 102 limit the pivot motion of pivot member 94, see FIG. 8. Tapered end 104 on extension allows the simple assembly of the bracket 50 with the extension, and the pivot 94 causes a part of the inturned foot member as at 106 to ride on edge 108 thereof and to enter notch 110 or 112 to latch the dropside in up or down position. When the attendant sees or hears this action, he will let go of the dropside and it will drop into notch extensions 114 or 116, respectively. This latches the dropside which cannot be raised or lowered without first lifting the dropside to clear the notch extension and secondly, pushing on the dropside to clear the notch 110 or 112 against the action of spring 96. The lower notch 110 may have a taper as shown in FIG. 4 so that the dropside can be moved straight up, but the upper notch cannot have such a taper because the up position of the dropside is the position that has to be fully protected against accidental falling.

I claim:

1. A crib construction comprising end walls, side walls, and interconnections therefor, and a mattress support frame, said frame including end extending elements to hold the frame in the crib, a vertical slide guide for each corner of the frame, said guides being located on the end walls in vertical position, edge grooves on each guide, and a plurality of openings in each guide, said openings being mutually vertically spaced and including a void behind and below each opening, a bracket for each guide, each bracket having side elements received in the grooves, a pivoted spring biassed hook on each bracket, the hook being continually urged toward the openings and automatically entering the openings when aligned therewith, the hook having an end portion entering the void by gravity and the hook being released from the guide manually.

an aperture in each bracket to receive the respective end extending element to support the frame in vertically adjusted position in the crib.

2. The crib of claim 1 wherein the guides are narrowed at at least one end to facilitate direct manual assembly and disassembly of each bracket on its respective guide.

* * * * *